US005115582A

United States Patent [19]

Westhead

[11] Patent Number: 5,115,582

[45] Date of Patent: May 26, 1992

[54] SPIRAL FABRIC PAPERMAKERS BELT HAVING ADJUSTABLE PERMEABILITY

[75] Inventor: William T. Westhead, Waycross, Ga.

[73] Assignee: Scapa, Inc., Waycross, Ga.

[21] Appl. No.: 382,028

[22] Filed: Jul. 19, 1989

Related U.S. Application Data

[63] Continuation of Ser. No. 48,466, May 11, 1987, abandoned, which is a continuation of Ser. No. 810,904, Dec. 20, 1985, abandoned, which is a continuation of Ser. No. 529,636, Sep. 6, 1983, abandoned.

[51] Int. Cl.[5] ..... D21F 1/10

[52] U.S. Cl. ..... 34/123; 162/348

[58] Field of Search ..... 162/348, 358, DIG. 1; 428/222; 139/283 A; 34/116, 123, 243 R

[56] References Cited

U.S. PATENT DOCUMENTS 3,920,117 11/1975 Roinestad ..... 198/194
4,346,138 8/1982 Lefferts ..... 162/348
4,362,776 12/1982 Lefferts et al. ..... 162/348
4,381,612 5/1983 Shank ..... 34/116
4,395,308 7/1983 Dawes ..... 162/348
4,460,023 7/1984 Mullaney ..... 162/DIG. 1

FOREIGN PATENT DOCUMENTS 19045 of 1912 United Kingdom .

*Primary Examiner*—Henry A. Bennet
*Attorney, Agent, or Firm*—Fleit, Jacobson, Cohn, Price, Holman & Stern

[57] ABSTRACT

A dryer felt comprising a plurality of spiral coils disposed in a common plane and arranged in a side-by-side relationship with adjacent coils being intermeshed and joined together in a hinged relationship by a hinge yarn. Stuffers are positioned within selected coils for predetermined distances to provide a fabric having a predetermined permeability profile across the width and along the length of the fabric.

33 Claims, 3 Drawing Sheets

SPIRAL FABRIC PAPERMAKERS BELT HAVING ADJUSTABLE PERMEABILITY

This application is a continuation of application Ser. No. 07/048,466, filed May 1, 1987, now abandoned, which is a continuation of Ser. No. 06/810,904, filed Dec. 20, 1985, now abandoned, which is a continuation of application Ser. No. 529,636, filed Sept. 6, 1983, now abandoned.

BACKGROUND OF THE INVENTION

1. Field of the Invention

The present invention relates to a spiral fabric papermakers felt, and more particularly to a dryer felt in the form a low permeability spiral coil fabric having stuffer materials positioned within certain of the coils to provide a fabric having a desired permeability profile in both the machine and cross-machine directions.

2. DESCRIPTION OF THE PRIOR ART

A conventional dryer felt or fabric consists of an open ended fabric, joined by means of a seam to form an endless belt, typically made from a two, three, or more plane fabric, wherein the various planes are defined by different groups of cross-machine direction yarns. The planes, plies, or layers, as they are variously called, are united by a plurality of machine direction yarns.

The yarns used to weave the most up-to-date dryer fabrics are generally made from synthetic monofilaments, synthetic multifilaments, or a combination of both from materials such as polyester, polyamide, acrylic, fiberglass or aramid fibers such as Kevlar and Nomex manufactured by E.I. duPont de Nemours and Co. Dryer felts made predominately from monofilament yarns have certain drawbacks. Because the monofilament yarns are relatively stiff, they are not easily bent around each other during the weaving process, and thus the fabric that results has a relatively open structure. There are several positions on the papermaking machine that do not run or cannot run effectively when employing a very open fabric because of numerous problems with the paper sheet, such as thread-up, blowing, and flutter, which causes sheet breaks, and reeling problems.

A number of attempts to reduce the openness or permeability of dryer fabrics made predominantly of monofilaments have been made. One approach has been to use a bulky spun yarn as a cross-machine stuffer pick in the middle of the weave pattern. These stuffer picks are, in effect, surrounded by the original monofilament cross-machine direction picks that are positioned in both the face and back surfaces of the fabric. This approach has been successful in reducing permeability, but has not substantially improved the stability of the fabric. Additionally, the spun stuffer pick is prone to collect dirt and has a tendency to retain and carry moisture, a condition which is undesirable in a dryer fabric.

A second approach to reduce fabric permeability has been to modify the woven structure in such a way that the top, or face, cross-machine direction picks are offset in relation to the bottom, or back, cross-machine direction picks. Although this approach has produced relatively low permeability in an all monofilament fabric, there is no easy way to change permeability because the weave design does not permit the use of stuffer picks. Changes in yarn diameter are, of course, possible, but such changes can only be made within the limitations of the loom.

An additional approach to the control of permeability in a dryer felt involves the incorporation of warp yarns of rectangular cross section into a weave pattern that does not include provision for stuffer picks. In such a weave pattern, the warp or weft yarn typically floats on the paper-receiving surface of the fabric over a number of weft picks or warp ends. The longer the float, i.e., the more picks the warp yarn crosses, or the more ends the weft yarn crosses, before weaving back into the fabric, the less stable the fabric becomes. In this way, there is a tradeoff between permeability and fabric stability.

In addition to woven fabrics, certain types of non-woven structures have been employed as dryer felts or fabrics. Of particular interest in connection with the present invention are those non-woven structures made from a plurality of intermeshed spiral coils that extend in side-by-side relationship in the cross-machine direction, and in which adjacent coils are joined together by cross-machine direction hinge yarns.

As is presently known, the predominant approach to reducing permeability in such spiral fabrics involves filling the gap within a given spiral coil created when that spiral coil is secured by hinge yarns to two adjacent spiral coils. Typically the gap is filled with a stuffer-type yarn. Another approach uses smaller spirals in an attempt to reduce the size of the space within a given coil.

In the first approach, the stuffer yarns are usually inserted as an extra production step after the basic fabric has been manufactured and finished. Although permeability is reduced, fabric processing time is increased and, therefore, this approach is less economical. At the same time, the use of stuffer yarns tends to reduce the clean running of the fabric and also reduces its ease of cleaning as dirt will rapidly adhere to the stuffer yarn.

The use of smaller spirals, on the other hand, necessitates increasing the number of filling yarns (which act as hinge yarns) per unit length. This again reduces productivity and increases costs. Also, it has been observed that the reduction in permeability is relatively small, such fabrics, at best, having a permeability of 800 cfm or more.

In addition to reducing the overall permeability of dryer fabrics, it is also desirable to provide such fabrics having different permeabilities across their widths. For example the paper sheet may have less moisture at the edges than at the center and it is therefore desirable that the edges of the fabric have a lower permeability than the center so that the drying effect on the paper sheet is less at the edges and more in the center. By the use of such dryer fabrics, problems such as grainy edges, sheet curl, dry edges, uneven moisture profile, and poor reel condition can be minimized or eliminated.

Similarly, if the paper sheet has a lower moisture content at the center than at the edges, then it is desirable to have a lower permeability in the center of the dryer fabric. Again, fabrics having variable permeability will help to eliminate such problems as wet edges, uneven moisture profile, and poor reel condition.

A woven fabric having different permeabilities across its width is not a new concept, and some early woven fabrics were designed with increased machine direction ends in the low permeability areas. This type of design reduced the load per machine direction end in the closed area compared with the open area and led to problems of fabric instability because the open area was prone to stretch more than the closed area. More recent designs have used increased numbers of cross-machine direction yarns in the closed area thus overcoming the disadvantages noted above when machine direction yarns were increased. However, while this approach overcomes one problem it can create another in that increasing the number of cross-machine direction yarns increases the machine direction yarn crimp in the closed areas compared with the open areas. The increased crimp in the machine direction yarns can cause the closed areas to stretch more than the open areas when subjected to the same load, sometimes resulting in slack edges to the fabric.

There is thus a need for a dryer felt of spiral coil construction that can be easily and economically produced, that has a wide permeability range which can be accurately controlled, that is stable and also dirt resistant, and that exhibits reduced moisture carrying properties. The present invention is directed toward filling that need.

SUMMARY OF THE INVENTION

The present invention is directed primarily to a dryer fabric although potential applications include forming wires, press fabrics, and other industrial belting applications where the accurately controlled permeability, smooth surface, and seam in line with the surface planes of the fabric are found to be advantageous. This is accomplished by using monofilaments of circular or non-circular cross-section to form a plurality of individual, side-by-side spiral coils that are held together by hinge yarns which can also be of circular or non-circular cross section. Coils at selected areas of the fabric are stuffed to reduce the permeability and provide a fabric of having controlled changes in permeability. The typical permeability for known spiral fabrics is about 800-plus cfm at ½" water gauge, whereas for a dryer felt produced according to the teachings of the present invention, the permeability can be accurately controlled in the range from about 50 to about 800 cfm. The range is controlled by selectively positioning stuffers within complete coils or within only portions thereof.

The dryer fabric of the present invention takes the form of a spiral fabric that consists of lengths of spiral monofilament or monofilament-like coils arranged so that they extend in a cross-machine direction and lie in a common plane. An example of a monofilament-like coil is a coil made from a bundle of multifilaments or fine monofilaments that have been resin treated in a conventional manner so that the bundle acts as a monofilament.

In production, a first spiral coil is usually laid out to the required width of the fabric. A second spiral is then intermeshed (single coil to single coil) with the first spiral and a monofilament hinge yarn is inserted between the intermeshed coils to hold them together. In order to reduce torque in the fabric, the spiral lengths of the individual coils are alternately S-twist and Z-twist coils. The spiral coils can be from circular cross section yarns or from yarns having non-circular cross sections, which can be, for example, elliptical or rectangular.

The hinge yarns can also have either a circular or a non-circular cross section and are sized and shaped relative to the spiral coils so that, when the hinge yarns join adjacent coils together, they do so in such a manner that they do not completely fill the opening defined when the coils are intermeshed.

After the hinge yarns are inserted, the resultant fabric is then subjected to heat treatment under controlled tension. Under these conditions, the various coils are flattened and lie against the sides of the hinge yarns. This structural arrangement provides a greater contact area between the fabric and the paper sheet with an increase in drying efficiency resulting in higher productivity of the paper machine and reduced energy costs. It also provides greater contact area between the fabric and the machine rolls, thereby providing more positive control and guiding of the fabric.

After heat treatment, stuffers in the form of generally rectangular monofilaments, braided polyester tape, or both, are inserted within certain selected coils, either adjacent the edges of the fabric or at the center thereof, as desired, to reduce the fabric permeability at those areas.

It is thus a primary object of the present invention to provide a dryer fabric of spiral construction having a wide but accurately controlled permeability range, good stability, good resistance to dirt, and which can be easily cleaned.

It is another object of the present invention to provide a dryer fabric made of monofilament or monofilament-like spiral coils within which stuffers are provided at predetermined areas to selectively control the permeability of the fabric.

It is still another object of the present invention to provide a dryer fabric of spiral construction having flattened paper-receiving and machine-roll contacting surfaces for improved web support and for improved guiding.

These and other objects will become apparent from the following drawings and detailed description.

DETAILED DESCRIPTION OF THE DRAWINGS

Figure 1:
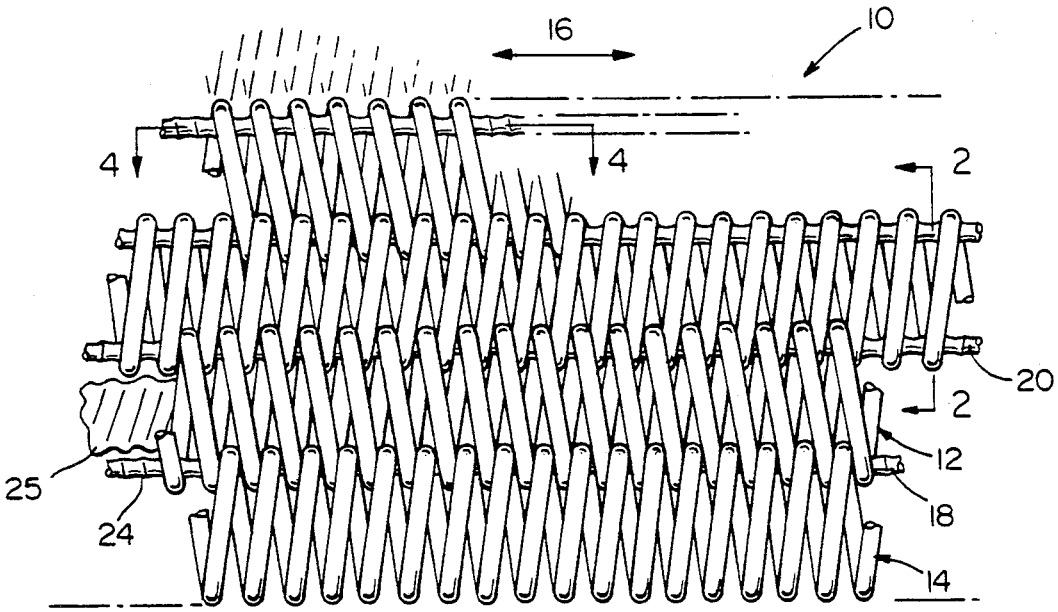
FIG. 1 is a fragmentary top plan view of a spiral papermakers fabric.
Figure 2:
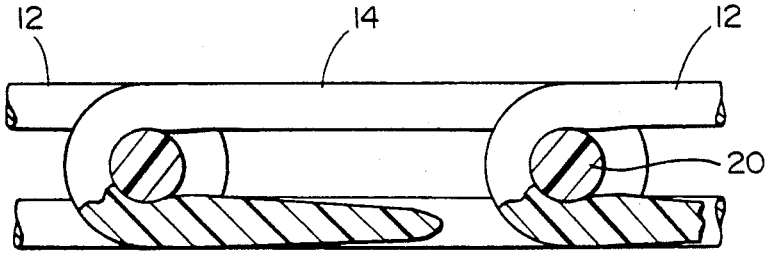
FIG. 2 is a fragmentary cross-sectional view of the fabric of FIG. 1 taken along the line 2—2.

With reference to FIGS. 1 and 2, a portion of a dryer fabric produced according to the teachings of the subject invention is shown and generally identified as 10. It is to be understood that the figures are in the nature of schematic representations and do not illustrate the elements of the fabric to any precise scale.

The dryer felt 10 basically comprises a plurality of spiral S-coils 12 joined together with a plurality of spiral Z-coils 14 through the use of hinge yarns 20 to define the fabric. The letters "S" and "Z" indicate the direction of twist of the spiral coils. A spiral coil has an S-twist if, when it is held vertically, the spirals or convolutions around its central axis slope in the same direction as the middle portion of the letter S, and a Z-twist if the spirals slope in the same direction as the central portion of the letter Z.

With reference to FIGS. 1 and 2, the details of the fabric structure will now be described. The spiral coils 12 and 14 each consist of lengths of spiral monofilament, i.e., a monofilament with the appearance of a spring coil. The monofilament is synthetic in nature and is typically made from polyester, although other materials, such as polyamide, polyolefin, polyetheretherketone, and the like are contemplated.

In constructing a spiral fabric, a spiral coil (in this case S-coil 12) is first selected and laid out in what will eventually become the cross-machine direction, as indicated by arrow 16. Thus it can be appreciated that the width of the dryer fabric is thereby determined by the length of the coil. A second spiral (in this case Z-coil 14) is then intermeshed with the first spiral coil 12 to define a hinge yarn receiving opening 18. The opening 18 receives a hinge yarn 20, which also extends in the cross-machine direction and which is also typically a synthetic monofilament, and, like the spiral coils, may be made of polyester, polyamide, polyolefin, polyetheretherketone, and the like. When inserted into adjacent intermeshed spiral coils, the hinge yarn acts as a pivot or hinge interconnecting the adjacent coils.

The laying down of additional spiral coils in an alternating 'S' coil and 'Z' coil relationship with the subsequent insertion of a hinge yarn is continued until a fabric of desired length is produced. The spiral coils are alternately S-twist and Z-twist coils so as to reduce torque in the fabric.

Figure 3:
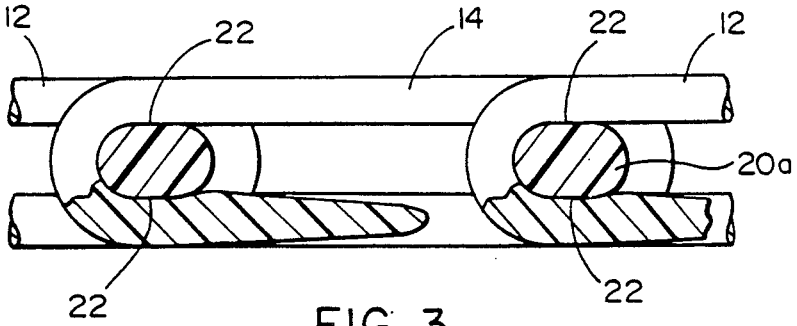
FIG. 3 is a fragmentary cross-sectional view similar to FIG. 2 of an embodiment of the fabric having hinge yarns of rectangular cross section.

As shown in FIGS. 2 and 3, it can be seen that the hinge yarns 20, 20*a* can be of circular or of non-circular cross section, respectively. The yarns of non-circular cross section partially close the spaces or air voids between spiral coils to markedly reduce permeability uniformly over the fabric. The overall size and shape of the hinge yarn depends on the size and shape of the spiral coils and the yarn-receiving openings that the coils define when they are intermeshed.

Figure 4:
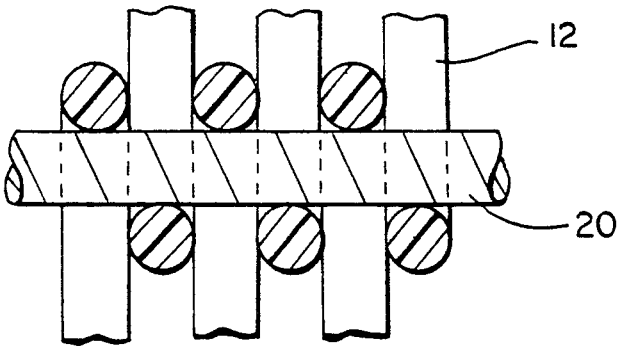
FIG. 4 is a fragmentary cross-sectional view of the fabric FIG. 1 taken along the line 4—4 of thereof.
Figure 5:
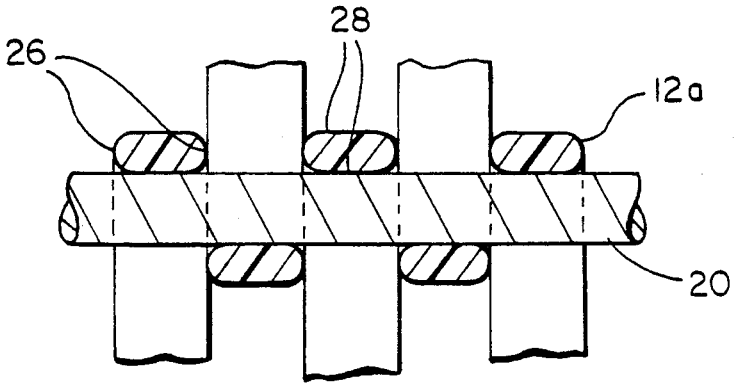
FIG. 5 is a fragmentary cross-sectional view similar to FIG. 4 of an embodiment of the fabric having coil yarns of rectangular cross section.

As shown in FIGS. 4 and 5, the yarns from which the spiral coils 12, 12*a* are formed can also be either of circular or of non-circular cross section, respectively. The generally rectangular yarns 12*a* provide greater surface contact area between the paper web and the fabric, and also provide greater surface contact area between the fabric and the machine rolls, thereby improving guiding of the fabric through the papermaking machine.

After the dryer fabric has been formed through the intermeshing of the S-twist and Z-twist coils and the insertion of the hinge yarns, the fabric is then subjected to heat treatment under controlled tension. The tension control acts in what will become the machine direction. Under these circumstances, the spiral coils 12, 14 which were originally circular or elliptical in transverse section now flatten to press up against the hinge yarns. At the same time, the controlled tensioning and resultant flattening of the spiral coils causes necessary crimping 24 (see FIG. 1) to occur in the hinge yarns. The crimp resulting from the heat treatment is desirable to stabilize the fabric and to ensure good runnability on the paper machine, i.e., no distortion or stretching. The crimping also ensures that the hinge yarns do not move laterally so as to leave an opening at either edge of the fabric. Thus, upon completion of the heating under controlled tension operations, a fabric results in which the hinge yarns all lie in a common plane. In like manner, the spiral coils are flattened and also lie in the same common plane of the fabric.

The flatness of the paper-receiving and machine-roll contacting surfaces of the dryer fabric can be controlled by the appropriate use of temperature, time, and tension. The spirals are flattened so that they are pulled into close contact around the sides of the hinge yarns by increasing either the temperature, the time, or the tension, or any combination of those factors. The flatter the surfaces of the dryer fabric, the greater is the contact area between the fabric and the paper sheet, as well as the contact area between the hot cylinder surface and the same paper sheet. This increases drying efficiency and results in higher productivity of the paper machine, thereby reducing energy costs. In addition, by increasing the contact area, there is less chance of the fabric marking the paper sheet, particularly on critical paper grades.

Increasing the mass of the monofilament hinge yarn 20 in a given area within the fabric causes a reduction in air voids. In this way, the fabric maintains a higher operating temperature so that dryer efficiency is enhanced. Additionally, the dimensional stability of the dryer fabric is increased by the use of the large hinge yarns 20, because there is less 'void' area available for the coils to move into.

The improved fabric flatness on the surfaces of the fabric improves calendaring effects by imparting increased smoothness to the paper sheet. Also, the increased flat contact area decreases the picking effect of the fabric on the paper sheet on after-size and after-coating positions, since there are no weave imperfections that the size or coating can adhere to.

It has been found that flatter upper and lower surfaces of the fabric can be obtained by using coils formed from yarns having non-circular cross sections, and particularly yarns having generally rectangular cross sections. Specifically, when coils formed from generally rectangular cross sections are employed, the flatter, and therefore greater, surface area of the resulting fabric provides increased contact area with the paper web, for increased drying efficiency and improved web support. It also provides increased contact area with the respective guide rolls which are found in papermaking machines and about which the fabric passes. By virtue of the increased guide roll contact, the guiding of the fabric around the several rolls is substantially improved, and it also has been found that the resistance to surface abrasion of the resulting fabric is also improved by virtue of the greater contact area.

By providing coils formed from yarns having rectangular or other non-circular cross sections, the thickness of the resulting fabric is reduced, thereby increasing its flexibility and minimizing the presence of moisture laden air therewithin, which avoids rewetting of the paper sheet. Moreover, because the fabric is thinner, the unit mass of yarns is greater and therefore the amount of air acting as insulation is diminished. This permits the fabric to run hotter which, with greater contact area, further increases the drying efficiency of the paper sheet. Thinner fabrics also involve less machine direction stretching of the paper sheet as it is carried around the various rolls on the outside surface of the fabric in a serpentine type run.

Structurally, the preferred coils having the attributes described above can be formed from monofilaments as illustrated in cross section in FIG. 5. The longer sides 28 are substantially flat and parallel and are so oriented that they lie generally parallel with the upper and lower surfaces of the resulting fabric. The spacing between the respective surfaces 28 defines the thickness of the coil yarn and the distance between the respective end portions 26 defines the width of the coil yarn. The width to thickness ratio of the coil yarns can range from about 1:1.1 to about 1:6, and preferably lies within the range from about 1:1.5 to about 1:2.0.

Figure 6:
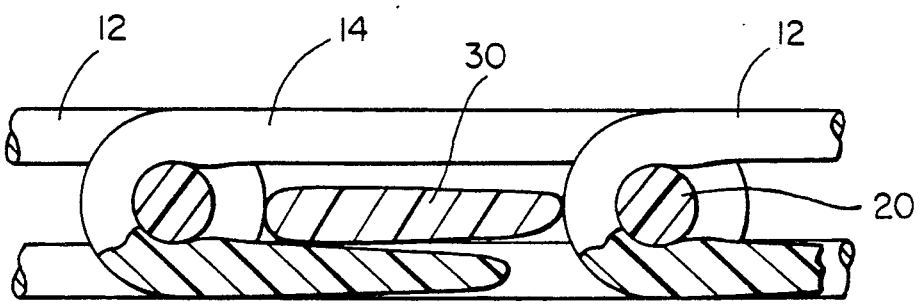
FIG. 6 is a fragmentary cross-sectional view similar to FIG. 2 showing a fabric having stuffers.

As shown in FIG. 6, stuffers or filler strips 30 can be provided in the form of relatively flat monofilaments which have a size sufficient to permit them to be readily inserted into the spaces within the coils after the same have been flattened. It has been found that unless some method is provided to anchor such a monofilament stuffer to the fabric, the same could migrate outwardly during the course of passage of the fabric through the papermaking machine. In order to mininize the likelihood of lateral migration of monofilament stuffers, it has been found that the application of a resin, such as AC604, or TR407, each of which is an aqueous acrylic emulsion manufactured by Rohm & Haas will penetrate the surface of the fabric when applied thereto and will permit a bond to be formed between monofilament stuffer 30 and the inner surfaces of coil 14. Up to a 20% concentration of for example AC604 has been found to be suitable when combined with water as the solvent. Additionally, it has been found that the application of a sealing material, such as, for example, Pliobond, a liquid resin material manufactured by the Goodyear Tire and Rubber Company and applied along the edges of the fabric, will serve as a binder to hold the same together and also will serve to minimize lateral migration of the monofilament stuffers. Furthermore, the use of an overall coating of resin as hereinabove described permits further reduction in permeability by reason of the occupation by the resin of some of the interstices between the coils and the stuffers.

As an alternative way to minimize migration of the monofilament stuffers, the use of a heat deformable monofilament such as, for example, polyolefins and low melt polyamides, without a liquid resin permits the stuffers to become indented during the heat treating operation, as shown at 25 in FIG. 1, and to come into close contact with the coils, thereby forming individual gripping edges in contact with the respective coils, to thereby restrain lateral migration of the monfilament stuffer. Alternatively, polyester monofilaments can also be used, and although they do not deform as readily under the temperatures employed in the heat treating operation, they tend to buckle within the fabric and are retained by virtue of the buckling. The buckling effect is most pronounced if the stuffers are wide and thin (width range of 0.075 to 0.125 inches, preferably 0.085 to 0.110 inches, and thickness range of 0.005 to 0.030 inches, preferably 0.008 to 0.015 inches).

Another form of stuffer that can be used to reduce the permeability of the fabric is a generally rectangular, braided polyester tape. The braid width can be from 0.070 to 0.130 inches, preferably 0.080 to 0.110 inches, and the braid thickness can be from 0.002 to 0.030 inches, preferably 0.010 to 0.025 inches. Additionally, the braided polyester tape preferably has a maximum heat contraction of 3% at 200° C. As in the case of the monofilament stuffers, it is preferred, although not essential, that a suitable resin binder be utilized with the braided tape to help retain the tape in position, to further reduce the permeability of the fabric, and also to act as a water repellent to prevent absorption of water by the tape. The tape is of a generally flexible nature and is so sized as to be capable of readily fitting within the coils.

Figure 7:
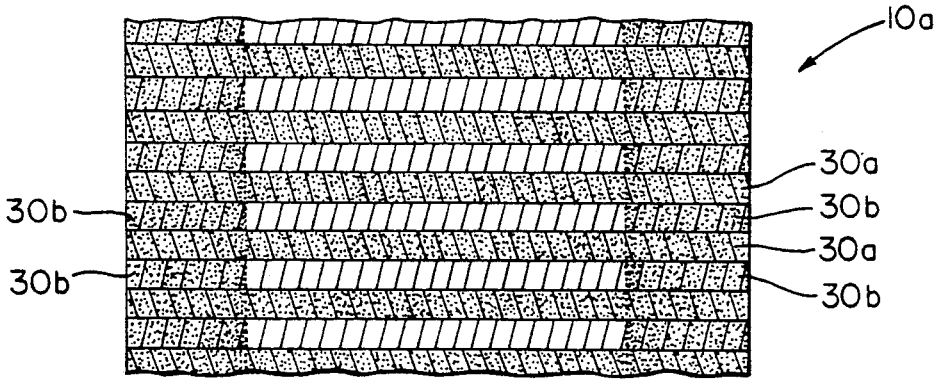
FIG. 7 is a fragmentary top plan view of a spiral fabric in accordance with the present invention having stuffers in alternate coils extending across the entire width and in intermediate coils extending partially inwardly at each of the edges of the fabric.
Figure 8:
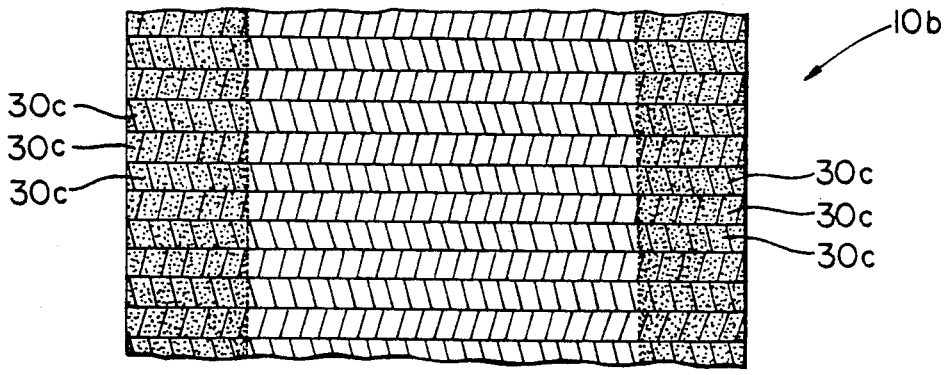
FIG. 8 is a fragmentary top plan view similar to FIG. 8 showing stuffers in each coil and extending partially inwardly from each of the edges of the fabric.
Figure 9:
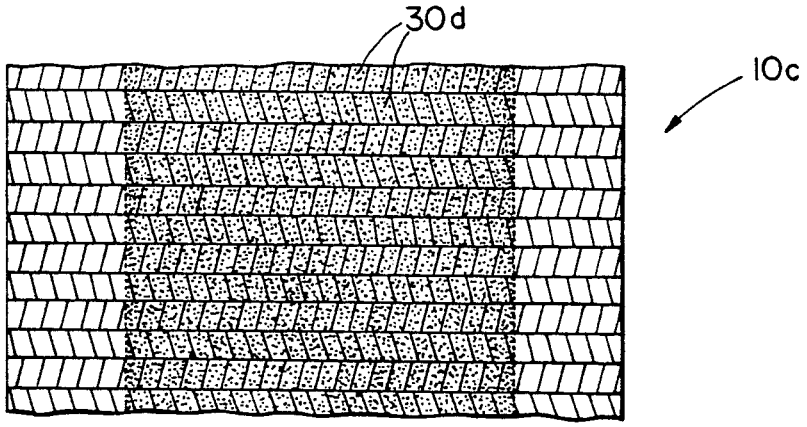
FIG. 9 is a fragmentary top plan view similar to FIG. 8 showing stuffers in the interior of the fabric and terminating short of each of the edges thereof.

FIGS. 7, 8, and 9 each illustrate a portion of a dryer fabric wherein stuffers have been provided within various of the coils to provide a desired permeability profile. For example, in FIG. 7, stuffers **30*a* have been provided in alternate coils across the entire width of fabric 10*a*, and the intermediate coils have been provided with stuffers 30*b* that extend inwardly from the edge of the fabric for a predetermined distance to further reduce the permeability at the outer edges of the fabric. Such a combination of stuffers would give a permeability of 300 to 400 cfm in the center and 50 to 200 cfm at the edges. The actual levels would depend on the size of the stuffing materials and also whether a resin was applied to the fabric edge to reduce permeability still further. 1O*b* wherein stuffers 30*c* are positioned along the respective edges of the fabric and in each adjacent coil. This embodiment would give a permeability of 50 to 200 cfm at the edges and 800** to 900 cfm in the center.

The embodiment illustrated in FIG. 9 shows fabric **10*c* with stuffers 30*d* positioned in the inner area of the fabric, leaving the outer edges more permeable. This embodiment with stuffers in every spiral in the center would have a permeability of 50 to 200 cfm, while the edges with no stuffers would have a permeability of 800 to 900 cfm. Although shown with stuffers 30*d*** in each coil, the stuffers can also be positioned in alternate coils, if desired, to provide a different permeability in the center of the fabric.

The stuffers are inserted into the heat-set fabric by being pulled into the openings defined by the flattened coils using a suitable gripper (not shown) at the end of a slender elongated shaft that is capable of passing into and through the coils. In connection with the braided tape stuffer, the tape was pulled through the fabric from one edge, and when the braid was fully inserted, a loop of braid was picked out of the spirals at the point of intended permeability change on the edge opposite the edge from which the gripper had been inserted. This loop was then cut, and the remaining braid, still attached to the gripper, was pulled through the fabric until the cut end was in line with the point of permeability change nearest the gripper. The tape was then cut from the gripper system approximately six inches outside the fabric edge, as was the tape at the other edge of the fabric. This process is repeated until all the desired coils have the appropriate length and position of braid and result in a fabric having an open center and closed edges. The six inches of stuffer beyond the fabric edge allows for any slight shrinkage or movement of the stuffer during heat treatment. After heat treatment the excess stuffer or filler strip material is trimmed off flush with the edge of the fabric, the edge is then heat sealed and Plioband resin, or the like, is applied.

For those fabrics in which open edges and a closed center (see FIG. 9) is desired, a similar technique is used. In this case the tape is pulled through the fabric and cut at the edge of the fabric furthest from the gripper head. The entire tape is then pulled through the fabric until the cut end is at the point of permeability change at the edge furthest from the gripper. When the tape is in this position a loop of braid is picked out of the fabric at the point of permeability change nearest to the gripper, the loop is cut, and the gripper and tape end is pulled out of the fabric. The resulting fabric has a reduced permeability in the center and greater permeability at the respective edges thereof.

The insertion of the monfilament stuffer can be accomplished in a similar fashion if its thickness is in the range 0.010 to 0.020 inches. If its thickness is in the range 0.020 to 0.030 inches it has sufficient stiffness to permit it to be pushed into the coils by hand, if desired.

The spiral coil fabrics hereinabove described typically have a permeability of approximately 800 cfm at ½ inch water gauge without stuffers. By means of the stuffer arrangements disclosed, the permeability of such fabrics can be reduced to approximately 50 cfm, if desired, and any intermediate value, depending upon the type of stuffer utilized and the number of coils in which it is inserted. It was experimentally determined that the application of one coat of the acrylic resin, which can be applied either by brush or by roller, resulted in an average reduction in permeability of approximately 5%, while after a second application the reduction was approximately 24%. Thus by suitable combinations of stuffer materials and configurations, and resin application, any combination of permeabilities ranging from about 50 cfm to about 800 cfm can be achieved across or along the fabric. Under production conditions the resin would be applied by spray, lick roll, squeeze roll, or any other method known in the art.

While particular embodiments of the present invention have been illustrated and described, it will be apparent to those skilled in the art that various changes and modifications can be made without departing from the spirit and scope of the invention, and it is intended to encompass within the appended claims all such changes and modifications that fall within the scope of the present invention.

What is claimed is:

1. A papermakers fabric having an upper surface and a lower surface, said fabric comprising:

a plurality of hinge yarns, all of said hinge yarns extending in a common direction;

a plurality of spiral coils disposed in a common plane in a side-by-side relationship, each of said coils extending in said common direction and having spaces therewithin, with adjacent coils of said spirals being intermeshed and held together in intermeshing relationship by at least one of said hinge yarns;

monofilament yarn stuffers positioned in the spaces within selected portions only of some or all of said coils and extending solely within said spiral coils and for predetermined distances in the spaces within the coils in said common direction, said fabric having areas in which coils are devoid of said stuffers and areas in which coils include said stuffers, thereby permitting a predetermined, variable permeability profile along and across said fabric, the permeability being less in the areas of the fabric in which coils having stuffers are located than in the areas of the fabric in which coils not having stuffers are located, wherein certain of said stuffers extending within respective ones of said spiral coils substantially completely across the full width of said fabric, and coils which are intermediate the coils containing said substantially full width stuffers includes edge stuffers which extend from each of the side edges of said fabric a predetermined distance to define open central areas in said intermediate coils; and means for holding said monofilament yarn stuffers within said coils to prevent migration of said stuffers in said common direction, wherein said holding means includes heat sealed portions at the edges of the fabric to at least partially close the ends of the coils.

2. The papermakers fabric of claim 1 wherein said coil yarns and said hinge yarns are a synthetic monofilament material.

3. The papermakers fabric of claim 2 wherein said synthetic material is chosen from the group consisting of polyester, polyamide, polyolefin and polyetheretherketone, and the like.

4. The papermakers fabric of claim 1, wherein said hinge yarns are of non-circular cross section.

5. The papermakers fabric of claim 4, wherein each of said non-circular cross sections has a long axis and a short axis, said long axis of said hinge yarns being aligned substantially parallel to the plane of the fabric, and said short axis of said hinge yarns being substantially perpendicular to the plane of the fabric.

6. The papermakers fabric of claim 1 wherein each of said coils is formed from a yarn having two pairs of opposed, substantially flat surfaces, one pair of said surfaces having a length greater than that of said other pair of surfaces when viewed in cross section, the longer of said surfaces lying in planes substantially parallel to said upper and lower surfaces of said fabric.

7. The papermakers fabric of claim 6 wherein said opposed surfaces are substantially parallel.

8. The papermakers fabric of claim 1 wherein each of said coils is formed from a non-circular yarn having a long axis and a short axis, said long axis of said coil yarns oriented substantially parallel to the upper and lower surfaces of said fabric and said short axis of said coil yarns oriented substantially perpendicular to said surfaces.

9. A papermakers fabric having an upper surface and a lower surface, said fabric comprising:

a plurality of hinge yarns, all of said hinge yarns extending in a common direction;

a plurality of spiral coils disposed in a common plane in a side-by-side relationship, each of said coils extending in said common direction and having spaces therewithin, with adjacent coils of said spirals being intermeshed and held together in intermeshing relationship by at least one of said hinge yarns;

monofilament yarn stuffers positioned in the spaces within selected portions only of some or all of said coils and extending for predetermined distances in the spaces within the coils in said common direction, said fabric having areas in which coils are devoid of said stuffers and areas in which coils include said stuffers, thereby permitting a predetermined, variable permeability profile along and across said fabric, the permeability being less in the areas of the fabric in which coils having stuffers are located than in the areas of the fabric in which coils not having stuffers are located, wherein said stuffers extend solely within said spiral coils from a point spaced from one edge of said fabric to a point spaced from said other edge thereof to provide a fabric having stuffers in the center area thereof and not at the edges; and holding means for holding said monofilament yarn stuffers within said coils to prevent migration of said stuffers in said common direction.

10. The papermakers fabric of claim 1 wherein said stuffers are of non-circular cross section.

11. The papermakers fabric of claim 10 wherein said non-circular cross section has a long axis and a short axis, said long axis being aligned substantially parallel to the plane of the fabric, and said short axis being substantially perpendicular to the plane of the fabric.

12. The papermakers fabric of claim 11 wherein said fabric is impregnated with a polymeric resin.

13. A papermakers fabric having an upper surface and a lower surface, said fabric comprising:

a plurality of hinge yarns, all of said hinge yarns extending in a common direction;

a plurality of spiral coils disposed in a common plane in a side-by-side relationship, each of said coils extending in said common direction and having spaces therewithin, with adjacent coils of said spirals being intermeshed and held together in intermeshing relationship by at least one of said hinge yarns;

monofilament yarn stuffers positioned in the spaces within selected portions only of some or all of said coils and extending solely within said spiral coils and for predetermined distances in the spaces within the coils in said common direction, said fabric having areas in which coils are devoid of said stuffers and areas in which coils include said stuffers, thereby permitting a predetermined, variable permeability profile along and across said fabric, the permeability being less in the areas of the fabric in which coils having stuffers are located in the areas of the fabric in which coils not having stuffers are located, wherein stuffers are positioned at opposing lateral edges of respective ones of said coils and extend inward from each of the side edges of said fabric a predetermined distance to define an open area in central portions of said coils; and means for holding said monofilament yarn stuffers within said coils to prevent migration of said stuffers in said common direction, wherein said holding means includes heat sealed portions at the edges of the fabric to at least partially close the ends of the coils.

14. The papermakers fabric of claim 1, wherein said holding means includes a resin coating applied to said fabric to provide a bond between said stuffers and inner surfaces of said coils.

15. The papermakers fabric of claim 1, wherein said holding means includes indentations formed in said stuffers, said indentations contacting inner surfaces of said coils.

16. The papermakers fabric of claim 1, wherein said holding means includes buckled portions of said stuffers in contact with the coils.

17. A papermakers fabric having an upper surface and a lower surface, said fabric comprising:

a plurality of hinge yarns, all of said hinge yarns extending in a common direction;

a plurality of spiral coils disposed in a common plane in a side-by-side relationship, each of said coils extending in said common direction and having spaces therewithin, with adjacent coils of said spirals being intermeshed and held together in intermeshing relationship by at least one of said hinge yarns;

braided tape stuffers woven from thermoplastic multifilaments and positioned in the spaces within selected portions only of some or all of said coils and extending solely within the spiral coils and for predetermined distances in the spaces within the coils in said common direction, said fabric having areas in which coils are devoid of said stuffers and areas in which coils include said stuffers, thereby permitting a predetermined, variable permeability profile along and across said fabric, the permeability being less in the areas of the fabric in which coils having stuffers are located than in the areas of the fabric in which coils not having stuffers are located, wherein stuffers are positioned at opposing lateral edges of respective ones of said coils and extend inwardly from each of the side edges of said fabric a predetermined distance to define an open area in central portions of said coils; and means for holding said braided type stuffers within said coils to prevent migration of said stuffers in said common direction, wherein said holding means includes heat sealed portions at the edges of the fabric to at least partially close the ends of the coils.

18. The papermakers fabric of claim 9, wherein side stuffers are of non-circular cross section.

19. The papermakers fabric of claim 18, wherein said non-circular cross section has a long axis and a short axis, said long axis being aligned substantially parallel to the plane of the fabric, and said short axis being substantially perpendicular to the plane of the fabric.

20. The papermakers fabric of claim 19, wherein said fabric is impregnated with a polymeric resin.

21. The papermakers fabric of claim 9, wherein said holding means includes a resin coating applied to said fabric to provide a bond between said stuffers and inner surfaces of said coils.

22. The papermakers fabric of claim 9, wherein said holding means includes identations formed in said stuffers, said indentations containing inner surfaces of said coils.

23. The papermakers fabric of claim 9, wherein said holding means includes buckled portions of said stuffers in contact with the coils.

24. A method for making a nonwoven permeable dryer belt having a profiled permeability characteristic across the width of the belt which comprises:

joining a plurality of open helix strips to one another by intermeshing bend portions of the windings of adjacent ones of said helix strips to form a continuous channel across said fabric;

inserting a pintle through said channel to join said intermeshing bend portions together;

filling the open windings of said helix strips across only a limited portion of the width of said belt at opposing lateral edges with a monofilament edge filler strip extending laterally across said limited portion of said width to reduce air flow and lower the fabric permeability at said lateral edges;

fixing the location of said monofilament edge strips at said lateral edges of said belt; and trimming off excess material at the edges of said dryer belt along the length of said belt.

25. The method of claim 24 including inserting a base monofilament filler strip across the entire width of said belt prior to inserting said monofilament edge filler strip; and sealing said base and edge monofilament strip together with said helix strips to make an integral fabric structure at said lateral edges.

26. A method for making a nonwoven permeable dryer belt having a profiled permeability characteristic across the width of the belt which comprises:

joining a plurality of open helix strips to one another by intermeshing bend portions of the windings of adjacent ones of said helix strips to form a continuous channel across said fabric;

inserting a pintle through said channel to join said intermeshing bend portions together;

filling the open windings of said helix strips across only a limited portion of the width of said belt at opposing lateral edges with a monofilament edge filter strip extending laterally across said limited portion of said width to reduce air flow and lower the fabric permeability at said lateral edges; and fixing the location of said monofilament edge strips at said lateral edges of said belt.

27. The method of claim 26 including inserting a base monofilament filler strip across the entire width of said belt prior to inserting said monofilament edge filter strip; and sealing said base and edge monofilament strip together with said helix strips to make an integral fabric structure at said lateral edges.

28. A papermakers fabric having an upper surface and a lower surface, said fabric comprising:

a plurality of hinge yarns, all of said hinge yarns extending in a common direction;

a plurality of spiral coils disposed in a common plane in a side-by-side relationship, each of said coils extending in said common direction and having spaces therewithin, with adjacent coils of said spirals being intermeshed and held together in intermeshing relationship by at least one of said hinge yarns;

monofilament yarn stuffers positioned in the spaces within selected portions only of some or all of said coils and extending solely within said spiral coils and for predetermined distances in the spaces within the coils in said common direction, said fabric having areas in which coils are devoid of said stuffers and areas in which coils include said stuffers, thereby permitting a predetermined, variable permeability profile along and across said fabric, the permeability being less in the areas of the fabric in which coils having stuffers are located than in the areas of the fabric in which coils not having stuffers are located, wherein certain of said stuffers are positioned in alternate ones of said coils and extend substantially completely across the full width of said fabric, and coils which are intermediate said alternate coils include edge stuffers that extend inwardly from each of the side edges of said fabric a predetermined distance to define open central areas in said intermediate coils; and means for holding said monofilament yarn stuffers within said coils to prevent migration of said stuffers in said common direction, wherein said holding means includes heat sealed portions at the edges of the fabric to at least partially close the ends of the coils.

29. A papermakers fabric having an upper surface and a lower surface, said fabric comprising:

a plurality of hinge yarns, all of said hinge yarns extending in a common direction;

a plurality of spiral coils disposed in a common plane in a side-by-side relationship, each of said coils extending in said common direction and having spaces therewithin, with adjacent coils of said spirals being intermeshed and held together in intermeshing relationship by at least one of said hinge yarns;

braided tape stuffers woven from thermoplastic multifilaments and positioned in the spaces within selected portions only of some or all of said coils and extending solely within said spiral coils and for predetermined distances in the spaces within the coils in said common direction, said fabric having areas in which coils are devoid of said stuffers and areas in which coils include said stuffers, thereby permitting a predetermined, variable permeability profile along and across said fabric, the permeability being less in the areas of the fabric in which coils having stuffers are located than in the areas of the fabric in which coils not having stuffers are located, wherein certain of said stuffers extend within respective ones of said spiral coils substantially completely across the full width of said fabric, and coils with are intermediate the coils containing said substantially full width stuffers include edge stuffers which extend inwardly from each of the side edges of said fabric a predetermined distance to define open central areas in said intermediate coils; and means for holding said braided tape stuffers within said coils to prevent migration of said stuffers in said common direction, wherein said holding means includes heat sealed portions at the edges of the fabric to at least partially close the ends of the coils.

30. A papermakers fabric having an upper surface and a lower surface, said fabric comprising:

a plurality of hinge yarns, all of said hinge yarns extending in a common direction;

a plurality of spiral coils disposed in a common plane in a side-by-side relationship, each of said coils extending in said common direction and having spaces therewithin, with adjacent coils of said spirals being intermeshed and held together in intermeshing relationship by at least one of said hinge yarns;

braided tape stuffers woven from thermoplastic filaments and positioned in the spaces within selected portions only of some or all of said coils and extending solely within said spiral coils and for predetermined distances in the spaces within the coils in said common direction, said fabric having areas in which coils are devoid of said stuffers and areas in which coils include said stuffers, thereby permitting a predetermined, variable permeability profile along and across said fabric, the permeability being less in the areas of the fabric in which coils having stuffers are located than in the areas of the fabric in which coils not having stuffers are located, wherein certain of said stuffers are positioned in alternate ones of said coils and extend substantially completely across the full width of said fabric, and coils which are intermediate said alternate coils include edge stuffers that extend inwardly from each of the side edges of said fabric a predetermined distance to define open central areas in said intermediate coils; and means for holding said braided tape stuffers within said coils to prevent migration of said stuffers in said common direction, wherein said holding means includes heat sealed portions at the edges of the fabric to at least partially close the ends of the coils.

31. A papermakers fabric having an upper surface and a lower surface, said fabric comprising:

a plurality of hinge yarns, all of said hinge yarns extending in a common direction;

a plurality of spiral coils disposed in a common plane in a side-by-side relationship, each of said coils extending in said common direction and having spaces therewithin, with adjacent coils of said spirals being intermeshed and held together in intermeshing relationship by at least one of said hinge yarns;

braided tape stuffers woven from thermoplastic multifilaments and positioned in the spaces within selected portions only of some or all of said coils and extending for predetermined distances in the spaces within the coils in said common direction, said fabric having areas in which coils are devoid of said stuffers and areas in which coils include said stuffers, thereby permitting a predetermined, variable permeability profile along and across said fabric, the permeability being less in the areas of the fabric in which coils having stuffers are located than in the areas of the fabric in which coils not having stuffers are located, wherein said stuffers extend solely within said spiral coils from a point spaced from one edge of said fabric to a point spaced from said other edge to provide a fabric having stuffers in the center area thereof and not at the edges; and holding means for holding said braided tape stuffers within said coils to prevent migration of said stuffers in said common direction.

32. The papermakers fabric of claim 29 wherein said fabric is impregnated with a polymeric resin.

33. The papermakers fabric of claim 31, wherein said fabric is impregnated with a polymeric resin.

* * * * *